United States Patent [19]

Schönert et al.

[11] Patent Number: 4,772,384

[45] Date of Patent: Sep. 20, 1988

[54] JIGGING METHOD AND APPARATUS FOR GRAVITY SEPARATION IN THE FINE AND FINEST PARTICLE SIZE RANGES

[75] Inventors: Klaus Schönert, Tannenhöhe 4, 3392 Clausthal-Zellerfeld; Rolf Gerstenberg, Clausthal-Zellerfeld, both of Fed. Rep. of Germany

[73] Assignee: Klaus Schönert, Clausthal-Zellerfeld, Fed. Rep. of Germany

[21] Appl. No.: 870,129

[22] Filed: Jun. 3, 1986

[30] Foreign Application Priority Data

Jun. 7, 1985 [DE] Fed. Rep. of Germany ..... 3520570

[51] Int. Cl.[4] ..... B03B 5/22; B03B 5/24

[52] U.S. Cl. ..... 209/425; 209/427; 209/486; 209/488

[58] Field of Search ..... 209/18, 422–428, 209/437, 438, 440, 443, 444, 446, 453, 466, 468–471, 485, 486, 488, 494, 495

[56] References Cited

U.S. PATENT DOCUMENTS

| | | | |
|---|---|---|---|
| 25,280 | 8/1859 | Seymour | 209/468 |
| 1,237,237 | 8/1917 | Bookwalter | 209/425 |
| 1,491,870 | 4/1924 | Lide | 209/500 |
| 1,639,915 | 8/1927 | Wilmot | 209/423 |
| 1,736,008 | 11/1929 | Lide | 209/426 |
| 2,014,249 | 9/1935 | Fletcher | 209/44 X |
| 2,303,367 | 12/1942 | Kendall et al. | 209/495 X |
| 2,414,721 | 1/1947 | Cooper | 209/427 |
| 2,635,753 | 4/1953 | McLean | 209/495 X |
| 3,367,501 | 2/1968 | Eveson | 209/466 X |
| 3,407,929 | 10/1968 | Hoing | 209/44 X |
| 3,659,711 | 5/1972 | Cohen-Alloro et al. | 209/495 X |
| 3,703,237 | 11/1972 | Cohen-Alloro et al. | 209/426 |
| 4,035,288 | 7/1977 | Gibert et al. | 209/486 X |

FOREIGN PATENT DOCUMENTS

| | | | |
|---|---|---|---|
| 3339026 | 5/1985 | Fed. Rep. of Germany | 209/426 |
| 0882934 | 11/1961 | United Kingdom | 209/422 |

*Primary Examiner*—Robert B. Reeves
*Assistant Examiner*—Edward M. Wacyra
*Attorney, Agent, or Firm*—Kenyon & Kenyon

[57] ABSTRACT

In jigging for purposes of gravity separation of material to be concentrated the material is sorted into a heavy fraction which is withdrawn through a screen (2) and a light fraction withdrawn above the screen (2), by periodically passing flows from the bottom to the top through the feed material. If the material is predominantly of finer character, there will be a ragging (3) on the screen (2) composed of particles which are larger and usually also specifically heavier than those of the feed material. In this manner, however, the separation of feed material will be unsatisfactory in the fine particle size range having upper particle size limits between 300 μm and 1 mm, particularly so if the particle size ratio of the material is rather broad. To obtain high-grade concentrates, and high yields at the same time, also in the fine particle size range mentioned and in the finest particle size range below the same, therefore, it is provided that, below the feed bed (5) a filter layer (4) is introduced which consists of particles having a density approximately the same as that of the heavy fraction and a size which is within the limits of from 1.2 to 2.5 times the upper particles size limit of the feed material, the height of the filter layer corresponding to at least twice the mean particle size of the filter layer particles, that, for jigging, the feed bed (5) first is stratified such that the finer particles of the specifically lighter material mainly are moved into the upper part of the feed bed (5), and that, during jigging, the periodic inflowing is effected or adjusted in frequency such that the filter layer will adopt a porosity of between 60% and 70% by the upward stroke and the stroke amplitude will range between 50% and 200% of the filter layer height. A jig for carrying out the method is disclosed as well.

10 Claims, 4 Drawing Sheets

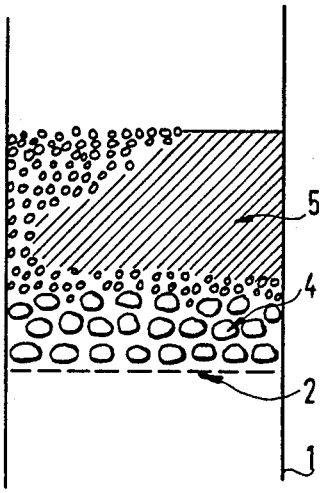
FIG. 1
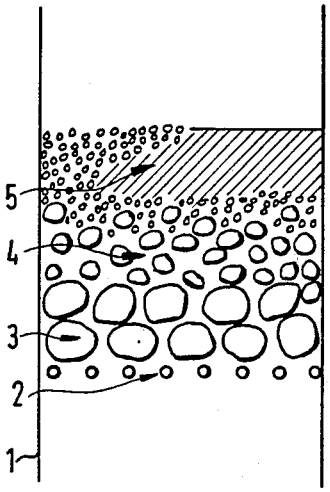
FIG. 2
FIG. 5
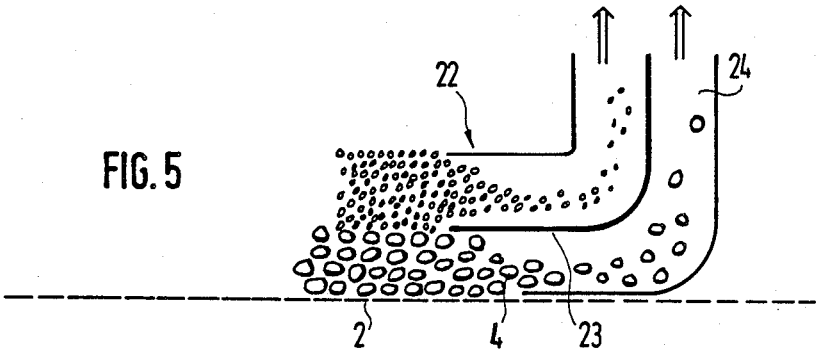

JIGGING METHOD AND APPARATUS FOR GRAVITY SEPARATION IN THE FINE AND FINEST PARTICLE SIZE RANGES

For many centuries mixtures of minerals have been separated in jigs because this not only is economically advantageous but also ecologically safe. The application of jigging is subject to the condition that, first, the densities of the substances to be separated are clearly distinct and, second, the particle size ratio of the mixture to be treated (feed material) is limited. The particle size ratio is understood to refer to the ratio between the upper particle size limit and the lower particle size limit. The products obtained from jigging are classified as the heavy fraction or concentrated material, middlings, and the light fraction or light material. The first is to consist primarily of particles having the highest density, while particles of the lowest density predominantly are to make up the light fraction. Interlocked particles as well as smaller heavy or larger light material particles are contained in the middlings.

Jigging is widely used in cleaning coal of a particle size range between approximately one millimeter and approximately one decimeter. The particle size ratios which can be processed range from 1:10 to 1:20. Further fields in which jigging is applied are the separation of heavy industrial minerals, the washing of iron ores and nonferrous metal ores. The present day state of the art permits concentrating mineral mixtures which have lower particle size limits of from approximately 0.5 to 1 mm. Mixtures including finer parts are fed as well in practice, yet their treatment hardly is separation in the particle size range below the limit mentioned. Instead, the share of fine particles is removed more or less completely with the light fraction. The resulting product is a slime-free concentrate of heavy material and, perhaps, a slime-free middling product.

In jigging processes a liquid medium, usually water, is passed periodically in upward and downward directions through the feed material to be separated which is located on a perforated plate or screen. With medium flow velocities properly adjusted, the particles of greater density collect at the bottom, while those of less density remain on top, thereby being separated. The periodic flow-through may be effected either by moving the screen up and down in the medium or, when using a stationary screen, by exciting the medium so that it will move up and down periodically. To this end pistons may be provided or pressurized air be used.

If the major part of the feed material is of coarse nature, having a particle size greater than a few millimeters, the discharge is effected entirely above the screen, the heavy fraction being separated from the light fraction by suitable means, such as splitters or knifes. If the material mainly is finer, below a few millimeters, the heavy fraction is removed through the screen. With this mode, also referred to as hutching, there is a ragging on the screen composed of particles which are greater and usually also specifically heavier than those of the feed material.

It is customary to use raggings comprising feldspar particles in coal jigs, while jigs used for ores contain raggings of steel bullets or steel beads, magnetite, and the like. The ragging mainly serves the purpose of permitting employment of screens which have apertures much larger than the coarsest particles in the feed material. The pores in the ragging must be of a size to permit passage even of the largest particles of the heavy fraction. However, in operating this type of jig, it can be observed that upon removal of the heavy fraction also particles of less density, in other words particles of the light fraction and interlocked particles pass downwardly through the ragging and the screen because the ragging has no blocking effect in response to the density.

For this reason mineral mixtures in the fine particle size range having upper particle size limits between approximately 300 μm and approximately 1 mm can be separated only insufficiently in the known jigs comprising raggings. Highgrade concentrates cannot be obtained at high recovery figures (high flow rate removal). This is true in particular if the feed material has a rather broad particle size ratio. Usually no more than pre-concentration can be obtained. Up to now mineral mixtures in the finest particle size range having upper particle size limits of between approximately 50 μm and approximately 300 μm practically cannot be separated at all by jigging.

It is, therefore, an object of the instant invention to widen the scope of application of the inexpensive and ecologically harmless jigging method for the recovery of highgrade concentrates and simultaneous great yields in the fine particle size range, having upper particle size limits of between about 300 μm and about 1 mm, and in the finest particle size range, having upper particle size limits of between about 50 μm and 300 μm. It is another object of the invention to provide a jigging method which is applicable to the broadest possible particle size ratios and which permits the highest possible mass flow rate. It is yet another object of the invention to provide jigs adapted to carry out the novel jigging process.

To meet the above objects, a method of jigging is provided, in accordance with the invention, for gravity separation of particulate feed material in the fine and finest particle size ranges disposed as a layer on a screen by subjecting in a working or jigging section periodically to vertical liquid medium flows or currents from the bottom to the top to obtain a heavy fraction which is withdrawn through a screen and a light fraction which is withdrawn above the screen. With this method a filter layer is introduced below the feed layer which filter layer comprises particles having a density approximately the same as that of the heavy fraction and a size which is within the limits of from 1.2 to 2.5 times the upper particle size limit of the feed material, the height of the filter layer corresponding to at least twice the mean particle size of the filter layer particles. Furthermore, for jigging, the feed layer first is stratified, as is known per se, such that the finer particles of the specifically lighter material mainly are moved into the upper part of the feed layer and, during jigging, the screen is moved horizontally from the feed point through the jigging section to the discharge point of the light fraction and the periodic upflowing in the jigging or working section is effected or adjusted in frequency such that the filter layer will adopt a porosity of between 60% and 70% by the upward stroke and the stroke amplitude will range between 50% and 200% of the filter layer height.

The invention further provides an apparatus for carrying out the method described, comprising in a jig casing a screen and pulsation chambers in a working or jigging section to generate a periodic upward flow of a liquid medium through the screen, as well as a feeder for material to be jigged and a discharge device for the light fraction. With this jig the screen is movable along a linear or circular horizontal path of motion from the feeder for the material to be treated through the working section to the discharge device for the light fraction and back to the feeder. Furthermore, a forerunning section including a feeding device for filter layer particles is arranged upstream of the working section, and an upflow, flat-section jet nozzle is disposed between said forerunning section including the feeding device and the working section including the pulsation chambers.

If the horizontal movement is circular, it is convenient to design the jig casing as a circular channel which is rotatable about the center of the circle or its central axis in the manner of a merry-go-round and along of which are arranged the feeder for the material to be jigged, the upflow flat-section jet nozzle, the pulsation chambers, and the discharge device for the light fraction.

It is possible to provide more than one of each section around the jig casing and to connect the same in parallel or in series.

In this event it is convenient to provide a discharge device for the filter layer in addition to the discharge device for the light fraction.

The invention provides the following:

(1) A filter layer is used which acts in response to the density of the feed material (density filtering effect) in operation (2) To obtain the response or sensitivity to density, dimensioning rules for the filter layer and distinctly given operating parameters to be observed are given.

(3) The conveyance of feed material from the feed point to the discharge point of the light fraction is not effected as is customary through hydraulic conveyance by delivering and removing additional water but instead by a horizontal conveying movement (mechanical conveyance) of the screen from the feed point to the discharge point.

The filter layer 4 composed of particles meeting the specification according to the invention is provided on a screen 2 or on a ragging 3 disposed on the screen, both inside a jig casing 1, as may be taken from FIG. 1 and 2, and the operating conditions are adjusted in accordance with the specifications according to the invention and given below. If the specification is observed, the filter layer 4 below the feed layer 5 will be given a blocking effect in response to the density as regards light material, in other words it will have the novel density filtering effect.

The filter layer specification and the operating conditions are as follows:

1. The filter layer 4 consists of particles having a density which is approximately the same as that of the heavy fraction and a size which is within the limits of from 1.2 to 2.5 times the upper particle size limit of the feed material.

It has a height $H_F$ which corresponds to at least twice the mean particle size of the filter layer particles. The density filtering effect is achieved by the filter layer 4 in operation passing over into a solids suspension layer the particles of which are greater than the apertures of the screen 2 or the pores of the ragging 3.

2. Before the jigging is initiated, i.e. prior to subjecting the feed material to periodic flows of a liquid medium, the feed material is stratified such that the finer particles of the specifically lighter material are moved mainly into the upper part of the feed material layer of food bed.

3. The periodic flows directed against the stratification formed, including the feed material in the feed layer are so adjusted that the filter layer 4 will reach a porosity of between 60% and 70% during the upward stroke and that the stroke amplitude will range between 50% and 200% of the height of the filter layer. The filter layer 4 can be converted into a suspension layer during the upward stroke only. The upward stroke is to be adjusted in consideration of the formation and maintenance of the porous density filter suspension layer. This is why specifications are given of the porosity of the filter layer and the stroke amplitude. With the known jigging methods the pulsing is adjusted to the size of the particles in the feed material and the height of the layer of feed material. In the case of the method according to the invention, on the other hand, the frequency and stroke amplitude depend on the density responsive filter layer provided for the first time, rather than on the ragging or feed material layer.

Rather than using additional water, as with known jigging methods and apparatus, the feed material is conveyed from the feed point to the discharge point of the light fraction by horizontal movement of the screen. This movement of the screen may be linear (FIGS. 3 and 4) or along a circle (FIGS. 6 to 8), especially when the operation is continuous as is preferred with high mass flow rates. Conveyance by extra water might cause such a change of the filter layer 4 that the density filtering effect would become disturbed.

The per se known stratification of the feed layer at the beginning of the pulsing upward flow enhances the retention of light fines upon recovery of the heavy concentrates.

Stratification of the feed material prior to jigging preferably is obtained by briefly subjecting the filter layer and the feed material on top of the same to an upflow of such velocity as to give the filter layer a porosity of between 60% and 80%. The stratification also may be obtained by supplying the feed material from a sufficiently high level into the jig casing or on the filter layer so that the desired stratification will form during the sedimentation in the medium. The measure of prestratifying the feed material fundamentally improves the separation efficiency.

If the above three rules are observed, the filter layer 4 surprisingly acts sensitive to density, in other words only particles of the heavy fraction can pass it in downward direction. The optimum adjustments of the operating conditions, within the limits specified above, to be found by simple orientation testing depend on the granulometric and densitometric compositions of the feed material. The granulometric composition is characterized by the particle size ratio ($x_{max}/x_{min}$) and the densitometric composition by the differential density quotient $Q=(\phi_S-\phi_f)/(\phi_L-\phi_f)$, wherein $\phi_S$, $\phi_L$, and $\phi_f$ designate the densities of the heavy and light fractions and of the medium, respectively. According to the fluidized bed theory a distinct relationship exists between mean particle size, particle density, porosity, and velocity of the onflow. Based on this instruction, those skilled in the art can either calculate or determine readily by testing the respective onflow velocity in any particular case. A value exceeding the upper limit indicated at least would lead to partial destruction of the filter layer and remedy thereof could be achieved only after a certain number of pulsing periods. Until then light material would be removed downwardly and this would deteriorate the result of the separation or the filter discrimination.

The prestratification as such, however, is not the essential basic concept of the invention but instead only an additional measure enhancing the sharp separation in the fine and finest particle size ranges.

Typical examples will be given below of optimum adjustments and results obtainable.

EXAMPLE 1

Feed material: iron ore - differential density quotient Q=2.5; upper particle size limit $x_{max}=630$ μm; particle size ratio 1:10; a ragging on the screen comprises specifically heavy particles having diameters of from 1.6 to 3.5 mm; the filter layer consists of magnetite particles between 800 and 1000 μm; the filter layer height $H_F$ is between 2.0 and 4.5 mm; the feed bed height is adjusted to a value between 30 and 60 mm; the jig stroke waveform is sinusoidal; the porosity obtained of the filter layer during the upward stroke is 60% to 70% at a frequency n of between 240 and 750/min.; the stroke amplitude h is between 5.1 and 1.6 mm; a 90% heavy fraction recovery is obtained; the magnetite grade is better than 95% by volume.

EXAMPLE 2

Feed material: iron ore - differential density quotient Q=2.5; upper particle size limit $x_{max}=200$ μm; particle size ratio 1:10; the filter layer consists of magnetite particles between 320 and 400 μm; the filter layer height $H_F$ is between 0.5 and 2.5 mm; the feed bed height H is adjusted to a value between 5 and 10 mm; the jig stroke waveform is sinusoidal; the porosity obtained of the filter layer during the upward stroke is 60% to 70% at a frequency n of between 700 and 1300/min.; the stroke amplitude h is between 0.3 and 0.8 mm; a 90% heavy fraction recovery is obtained; the magnetite grade is better than 95% by volume.

EXAMPLE 3

Feed material: coal differential density quotient Q=4.0; upper particle size limit $x_{max}=1000$ μm; particle size ratio 1:20; the filter layer consists of quartz particles between 1250 and 1600 μm; the filter layer height $H_F$ is between 2.5 and 6 mm; the feed bed height H is adjusted to a value between 30 and 80 mm; the jig stroke waveform is sinusoidal; the porosity obtained of the filter layer during the upward stroke is 60% to 70% at a frequency n of between 150 and 300/min.; the stroke amplitude h is between 2.5 and 9 mm; a 90% heavy fraction recovery is obtained; the quartz grade is better than 95% by volume.

Apart from the extremely high values of recovery and grade achieved, the capacities obtainable are remarkable as well. The mass throughput per unit area of the heavy fraction through the screen amounts to as much as 3 to 4 t/h $m^2$ in the case of example 1: 0.4 to 0.5 t/h $m^2$ with example 2; and 1.5 to 3 t/h $m^2$ with example 3. Comparable values obtained with a so-called mud jig for coal are 0.6 to 0.9 t/h $m^2$ when feeding coal of an upper particle size limit of 3 mm. At least 3 to 6 t/h $m^2$ would be obtainable if the method proposed by the instant invention were applied.

The method according to the invention may be realized in jigs as recited in the claims, operating either in the batch mode or continuously. Both embodiments have in common that the feed material is conveyed from the feed point to the discharge point by horizontal movement of the screen rather than by forces of flow or hydraulic transport.

Two embodiments of a jig according to the invention will be described further with reference to the accompanying drawings, in which:

FIG. 1 is a side cross sectional view of a jig casing.

FIG. 2 is a side cross sectional view of a jig casing.

FIG. 5 is a partial cross sectional elevation of a discharge device for light material for use with a jig;

Figure 3:
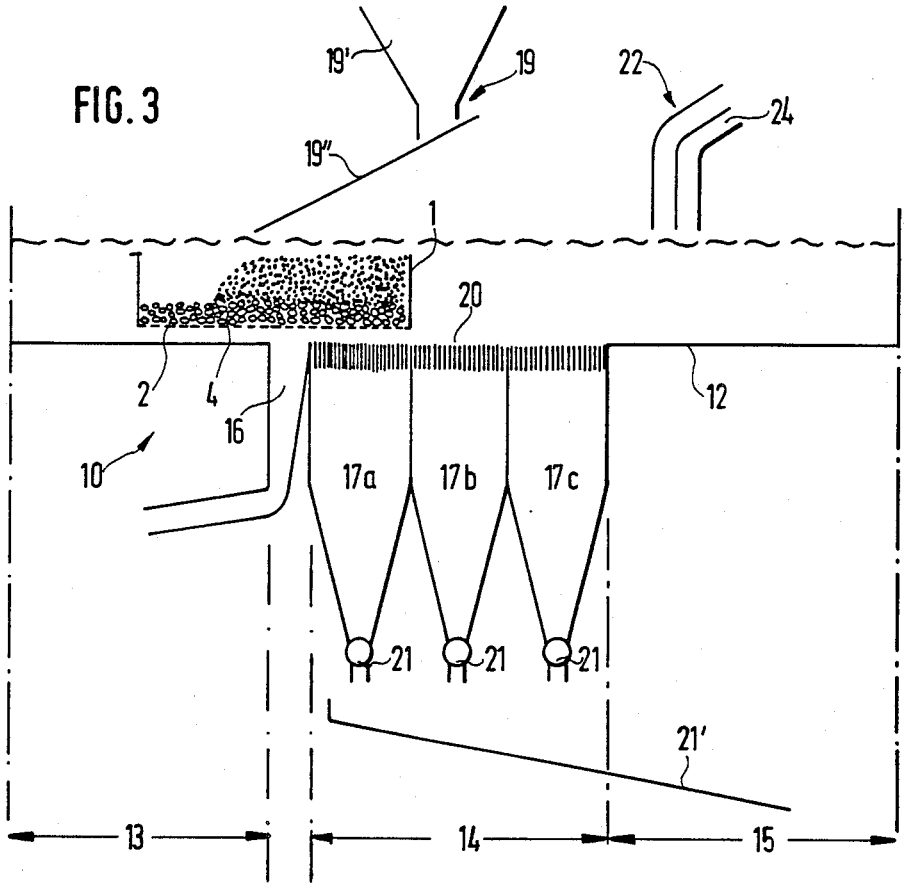
FIG. 3 is a diagrammatic longitudinal sectional elevation of a linear jig.
Figure 4:
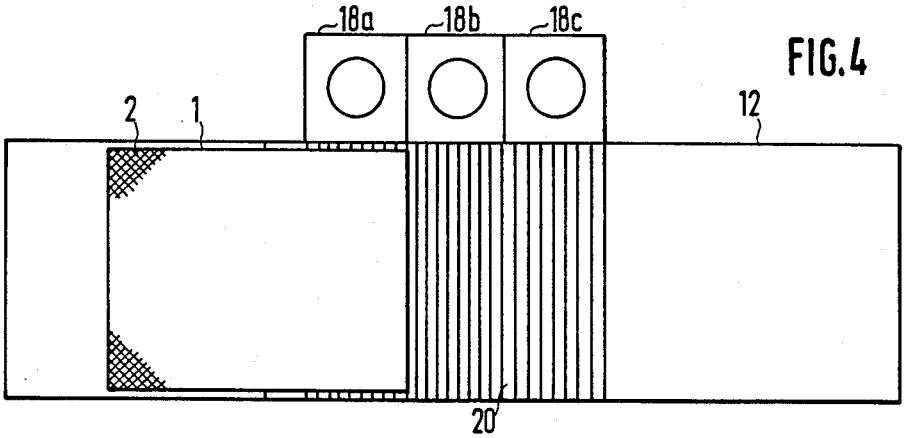
FIG. 4 is a top plan view of the jig shown in FIG. 3.

A linear jig 10 as shown in FIG. 3 for carrying out the method according to the invention comprises, in per se known manner, a jig casing 1 of rectangular cross section and adapted to reciprocate horizontally in a water hutch 12 which has a water inlet and outlet (not shown). The jig operates periodically in two cycles. The working cycle begings when the jig casing 1 is in the left position, as seen in FIG. 3, and the return cycle begins upon removal of the light fraction layer when the jig casing 1 has reached the right hand terminal position. The water hutch 12 comprises three sections, the forerunning section 13 at the left, the working section 14 in the middle, and the outlet section 15 at the right. Between the fore running section 13 and the working section 14 there is an upflow flat-section jet nozzle 16 which is followed by a plurality of pulsation chambers 17*a*, 17*b*, 17*c* in the working section 14. The water is excited periodically by pulsators 18*a*, 18*b*, and 18*c* mounted at the side of the water hutch 12, as may be seen in the top plan view of FIG. 4. The frequencies and amplitudes of the strokes thereof may be adjusted to different values, respectively. The feed material is introduced in the forerunning section 13 by a feeder 19 including a funnel 19' and a chute 19'', after having previously applied a filter layer 4 on the screen 2. The prestratification of the feed material takes place as the feed material passes the upflow flat-section jet nozzle 16, and the feed material is separated as it passes over the puslation chambers 17*a*, 17*b*, and 17*c*. If desired, flow rectifiers 20 may be mounted below the screen 2 to warrant uniform inflow into the same. These rectifiers may be secured either to the screen 2 or to the pulsation chambers. The heavy fraction which passed the screen is withdrawn from below, for instance by way of bucket wheel-type locks 21 and worms which deliver the concentrate to a chute 21'. A discharge device 22 embodied by a suction means serves to remove the light fraction. If desired, it may comprise a splitter 23, as indicated in FIG. 5, so as to maintain a given layer level in the jig casing 1. It may be useful to leave a thin layer of light material above the filter layer 4. Downstream of the discharge device 22 for the light fraction another discharging device 24 is provided in the form of a suction means which may be used to remove the filter layer 4 for cleaning prior to renewed charging. The return of the jig casing 1 to its left-hand starting position may be made faster than its advance or working motion.

Figure 6:
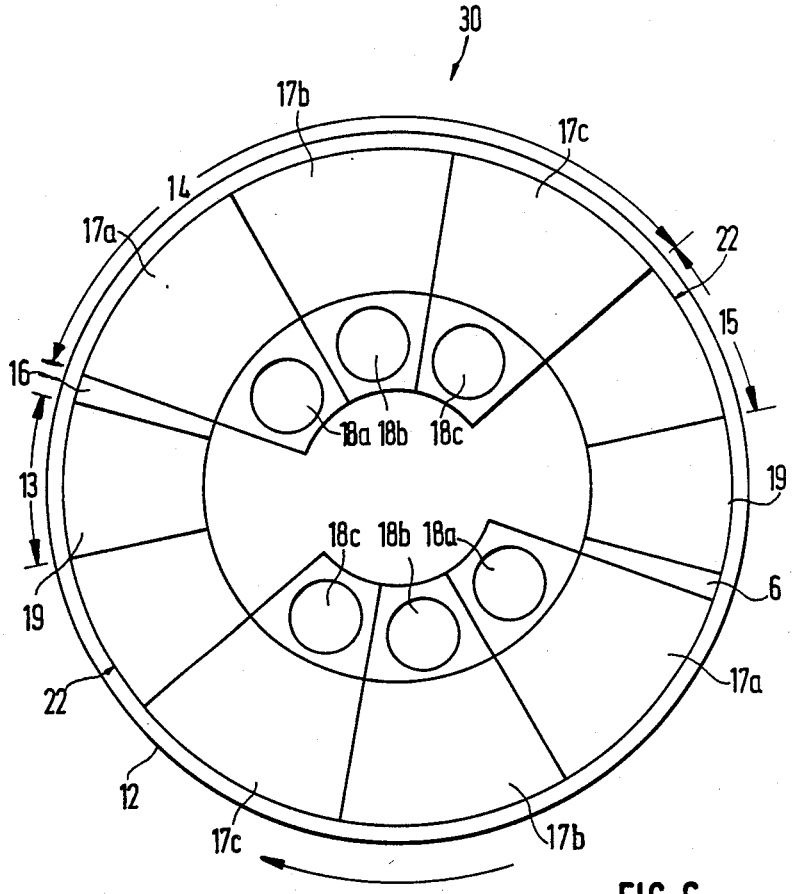
FIG. 6 is a top plan view of a circular jig illustrated only diagrammatically.
Figure 7:
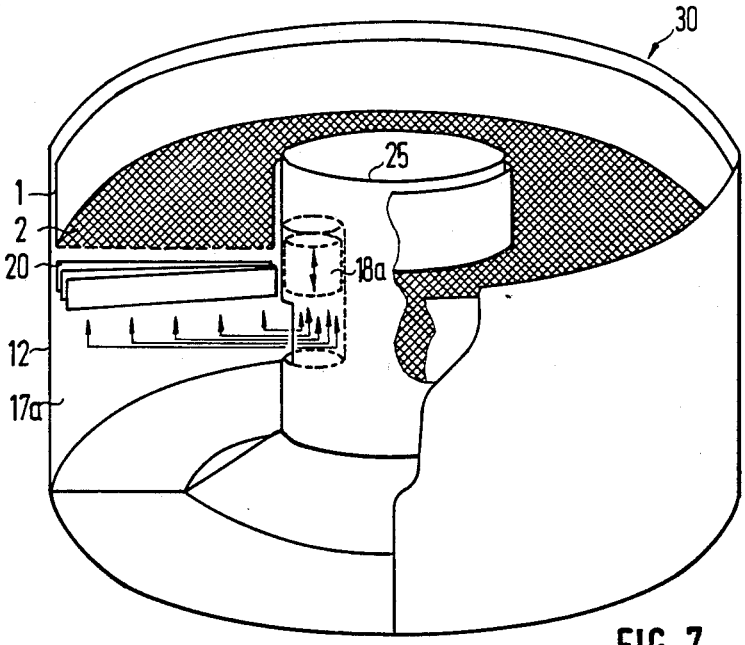
FIG. 7 is an oblique view, partly cut-away, of a circular jig.
Figure 8:
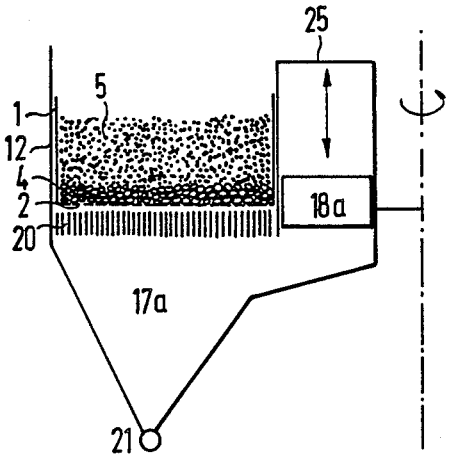
FIG. 8 is an axial sectional elevation of one half of the jig shown in FIG. 7 with a filter layer and a feed bed disposed on the screen thereof.

The circular jig or merry-go-round type of machine shown in FIGS. 6,7,and 8 permits fully continuous operation. The structure and mode of operation of this jig may be gathered directly from the specification of the linear jig. With this circular jig 30 the jig casing has the shape of a circular ring and it is rotatably supported in a cylindrical water hutch 12. As shown in FIG. 7, the circular screen 2 extends over the whole circumference of the hutch 12, and in doing so over two series of a forerunning section 13, an flow flatsection jet nozzle 16, a working section 14 and an outlet section 15. Flow rectifiers 20 embodied by radial lamellae extend beneath the screen 2 and above the pulsators 18, as may be seen in FIG. 7. The pulsators 18*a*, 18*b*, 18*c* in this case are mounted within a central cylindrical housing 25, laterally with respect to the inner wall of the jig casing 1. One pulsator 18*a* is shown in the drawing, associated with a pulsation chamber 17*a*.

A circular jig, too, may be realized so as to comprise two or more working sections which may be connected either in parallel or in series. The parallel connection serves to increase the rate of flow, the jig in this event having a greater diameter. In the case of a series connection, on the other hand, pre-concentration may be linked with after-cleaning.

As may be seen in FIG. 8, the water hutch 12 illustrated in FIG. 7 is extended like a funnel in downward direction in the area of the pulsation chambers, whereby the heavy concentrate may be discharged by means of bucket wheel-type locks 21.

What is claimed is:

1. A method of jigging particulate feed material in the fine and finest praticle size ranges to be concentrated by subjecting a layer of the feed material disposed on a screen in a working section periodically to vertical liquid medium flows from the bottom to the top of said feed material layer to obtain gravity separation into a heavy fraction which is withdrawn through the screen and a light fraction which is withdrawn above the screen, wherein below said feed material layer a filter layer is introduced which consists of particles having a density which is approximately the same as that of the heavy fraction and a size which is within the limits of from 1.2 to 2.5 times the upper particle size limit of the feed material, the height of the filter layer corresponding to at least twice the mean particle size of the filter layer particles, for jigging, said feed material layer first is stratified such that the finer particles of the specifically lighter material mainly are transported into the upper part of the feed material layer, and during jigging, the screen is moved horizontally from a feed point for introducing the feed material through the working section to a discharge point of the light fraction and the periodic inflowing is effected or adjusted in frequency such that the filter layer will adopt a porosity of between 60% and 70% by the upward stroke and the stroke amplitude will range between 50% and 200% of the filter layer height.

2. The method as claimed in claim 1, wherein prior to the jigging, an upflow is passed through the filter layer and the feed material layer to impart to the filter layer a porosity of between 60% and 80%.

3. The method as claimed in claim 1 or 2, wherein the screen is moved along a circular path from the feed point to the discharge point of the light fraction.

4. A jig for particulate feed material in the fine and finest particle size ranges to be concentrated by subjecting a layer of the material disposed on a screen in a working section periodically to vertical liquid medium flows from the bottom to the top of said feed material layer to obtain gravity separation into a heavy fraction which is withdrawn through the screen and a light fraction which is withdrawn above the screen, comprising within a jig casing a screen and pulsation chambers for producing the periodic upward liquid flow through the screen and said feed material layer, as well as a feeder for feed material to be jigged and a discharge device for the light fraction, wherein the screen is movable along a horizontal path of motion from the feeder for feed material to be jigged through a working section to the discharge device for the light fraction and back to the feeder, a forerunning section including a feeding device for filter layer particles arranged upstream of the working section, and an upflow flat-section jet nozzle arranged between said feeder and the working section including the pulsation chambers.

5. The jig, as claimed in claim 4, wherein said horizontal path of motion is circular, the jig casing has the configuration of a circular channel which is rotatable about the center axis of the circle and around the periphery of which are arranged the feeder for the material to be jigged, the upflow flat-section jet nozzle, the pulsation chambers, as well as the discharge device for the light fraction.

6. The jig as claimed in claim 5, wherein more than one working section are provided along the periphery of the jig casing.

7. The jig as claimed in claim 5 or 6, wherein in addition to the discharge device for the light fraction a discharge device for the filter layer is provided.

8. The jig of claim 6 wherein said more than one working section are connected in parallel.

9. The jig of claim 6 wherein said more than one working section are connected in series.

10. The jig of claim 4 wherein said horizontal path of motion is linear.

* * * * *